US008827441B2

(12) United States Patent
Okumura

(10) Patent No.: US 8,827,441 B2
(45) Date of Patent: Sep. 9, 2014

(54) LIQUID EJECTING DEVICE

(75) Inventor: Masayuki Okumura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 175 days.

(21) Appl. No.: 13/246,991

(22) Filed: Sep. 28, 2011

(65) Prior Publication Data

US 2012/0081491 A1 Apr. 5, 2012

(30) Foreign Application Priority Data

Sep. 30, 2010 (JP) ..... 2010-220527

(51) Int. Cl.
*B41J 29/13* (2006.01)
*B41J 2/165* (2006.01)
*B41J 29/02* (2006.01)

(52) U.S. Cl.
CPC ..... *B41J 29/13* (2013.01); *B41J 2/16585* (2013.01); *B41J 2/16505* (2013.01); *B41J 2/16588* (2013.01); *B41J 2/16547* (2013.01); *B41J 2/16508* (2013.01); *B41J 29/02* (2013.01)
USPC ..... 347/108; 347/29; 347/32

(58) Field of Classification Search
None
See application file for complete search history.

(56) References Cited

U.S. PATENT DOCUMENTS 5,289,213 A 2/1994 Murai et al.
5,825,392 A * 10/1998 Mochizuki ..... 347/197
5,867,187 A * 2/1999 Toniolo ..... 347/32
6,578,949 B2 * 6/2003 Takahashi et al. ..... 347/30
6,657,940 B1 * 12/2003 Takeda et al. ..... 720/655
6,659,586 B2 * 12/2003 Balcan et al. ..... 347/32
6,814,424 B2 * 11/2004 Park ..... 347/29
6,929,346 B2 * 8/2005 Balcan et al. ..... 347/32
8,430,487 B2 * 4/2013 Sekino ..... 347/86
2003/0218653 A1 * 11/2003 Maruyama et al. ..... 347/32
2005/0062793 A1 3/2005 Takagi et al.
2005/0248170 A1 * 11/2005 Kawamoto et al. ..... 296/24.34
2008/0074457 A1 * 3/2008 Okuda ..... 347/16
2009/0135224 A1 * 5/2009 Yakura et al. ..... 347/29

FOREIGN PATENT DOCUMENTS

JP S58-076289 A 5/1983
JP 63-254044 10/1988
JP H02-029346 A 1/1990

(Continued)

OTHER PUBLICATIONS

JP Office Action mailed Mar. 19, 2013, JP Appln. 2010-220527, English translation.

*Primary Examiner* — Laura Martin
*Assistant Examiner* — Leonard S Liang
(74) *Attorney, Agent, or Firm* — Banner & Witcoff, Ltd.

(57) ABSTRACT

A liquid ejecting device includes first and second housings. The first housing is movable between a proximity position and a separated position with respect to the second housing, and accommodates a liquid ejecting head. The first housing includes a cover attached to the first housing and movable with respect to the head between a protection position for the head and a retreat position, and a movement mechanism which causes the cover to move with the movement of the first housing. The movement mechanism includes a hole formed in the second housing, and an intermediate member including a protrusion movable along the hole with the movement of the cover. In the separated position, the protrusion abuts the hole in both directions in which force to move the cover between the retreat position and the protection position is applied so that the side walls restrict movement of the protrusion.

7 Claims, 4 Drawing Sheets

(56) References Cited

FOREIGN PATENT DOCUMENTS

| | | | | |
|---|---|---|---|---|
| JP | H04-011664 | U | | 1/1992 |
| JP | H04-029057 | U | | 3/1992 |
| JP | H04-345176 | A | | 12/1992 |
| JP | 2003-127402 | A | | 5/2003 |
| JP | 2003147796 | A | * | 5/2003 |
| JP | 2005-096187 | | | 4/2005 |
| JP | 2005-153185 | A | | 6/2005 |

* cited by examiner

LIQUID EJECTING DEVICE

CROSS-REFERENCE TO RELATED APPLICATION

This application claims priority from Japanese Patent Application No. 2010-220527, filed on Sep. 30, 2010, the entire subject matter of which is incorporated herein by reference.

TECHNICAL FIELD

Aspects of the present invention relate to a liquid ejecting device for ejecting liquid such as ink.

BACKGROUND

There are cases where users manually perform jam fixing operation (operation to remove jammed record media from a transfer path) or the like in a liquid ejecting device. In order to secure workspace for that operation, a related-art liquid ejecting device includes a housing configured by a first housing accommodating a liquid ejecting head, a second housing accommodating a support unit for supporting a record medium and so on, wherein the first housing is movable with respect to the second housing (for example, JP-A-S63-254044). According to this liquid ejecting device, as shown in FIG. 4 of JP-A-S63-254044, the first housing (an upper unit 1*a*) can be moved to a separated position spaced apart from the second housing (a lower unit 1*b*), such that a transfer path formed in the second housing is opened and workspace is secured over the transfer path.

Further, according to the above related-art liquid ejecting device, as shown in FIG. 5(B) of JP-A-S63-254044, when the first housing is in the separated position, an ejecting surface (a lower surface of a recording head 101) is covered with a cover (a sheet guide 201A) so as to prevent a user hand from touching the ejecting surface and prevent a foreign material from being attached to the ejecting surface. When the first housing is in the separated position, the cover is in a protection position to cover the ejecting surface (FIG. 5(B)), and when the first housing is in a proximity position, the cover is in a retreat position not to cover the ejecting surface (FIG. 5(A)).

SUMMARY

According to the above related-art liquid ejecting device, when the first housing is in the separated position, a user hand may touch the cover to apply an external force in a clockwise direction in FIG. 5(B) (a force in a direction to move the cover from the retreat position to the protection position). In this case, the movement of the cover is restricted by a stopper 311. However, in a case where an external force in a counterclockwise direction in FIG. 5(B) (a force in a direction to move the cover from the protection position to the retreat direction) is applied to the cover, since a stopper or the like for restricting the counterclockwise movement does not exist, the cover may move to the retreat position. In this case, the ejecting surface may be exposed to allow a user hand to touch the ejecting surface or a foreign material to be attached to the ejecting surface.

It is noted that the movement of the cover to the retreat position is suppressed by a biasing force of a spring 307 to some extent. However, if the strength of the external force exceeds the biasing force, the cover can be moved to the retreat position.

Accordingly, an aspect of the present invention provides a liquid ejecting device capable of effectively maintaining a cover at a protection position when a first housing is in a separated position.

According to one or more aspects described herein, a liquid ejecting device including a first housing, and a second housing. The first housing is movable with respect to the second housing between a proximity position close to the second housing and a separated position farther from the second housing than the proximity position, and accommodates a liquid ejecting head including an ejecting surface having a plurality of ejecting openings formed thereon for ejecting liquid to a record medium. The second housing accommodates a support member configured to support the recording medium to face the ejecting surface. The first housing includes a cover which is attached to the first housing, and which is movable with respect to the liquid ejecting head between a protection position to cover the ejecting surface and a retreat position not to cover the ejecting surface, and a movement mechanism which is configured to cause the cover to move in accordance with the movement of the first housing such that the cover takes the retreat position when the first housing is in the proximity position and takes the protection position when the first housing is in the separated position. The movement mechanism includes a hole formed in the second housing, and a protrusion which is movable along the hole while being inserted into the hole, which is provided to an intermediate member attached to the first housing and engaged with the cover, and which is moved in accordance with the movement of the cover. When the first housing is in the separated position, the protrusion abuts on side walls of the hole with respect to a direction in which a force to move the cover from the retreat position to the protection position is applied, and a direction in which a force to move the cover from the protection position to the retreat position, so that the movement of the protrusion is restricted by the side walls.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, illustrative embodiments of the present invention will be described with reference to the accompanying drawings.

An entire configuration of an inkjet printer 1 according to an illustrative embodiment of the present invention will be described with reference to FIGS. 1 and 2.

The printer 1 includes a first housing 1*a* and a second housing 1*b* which have a rectangular parallelepiped shape and have the substantially same size in a main scan direction and a sub-scan direction. The first housing 1*a* is open at its lower face and the second housing 1*b* is open at its upper face. The first housing 1*a* overlaps the second housing 1*b* such that the first housing 1*a* and the second housing 1*b* cover each other's open face, whereby the inside space of the printer 1 is defined (see FIG. 2).

Figure 2:
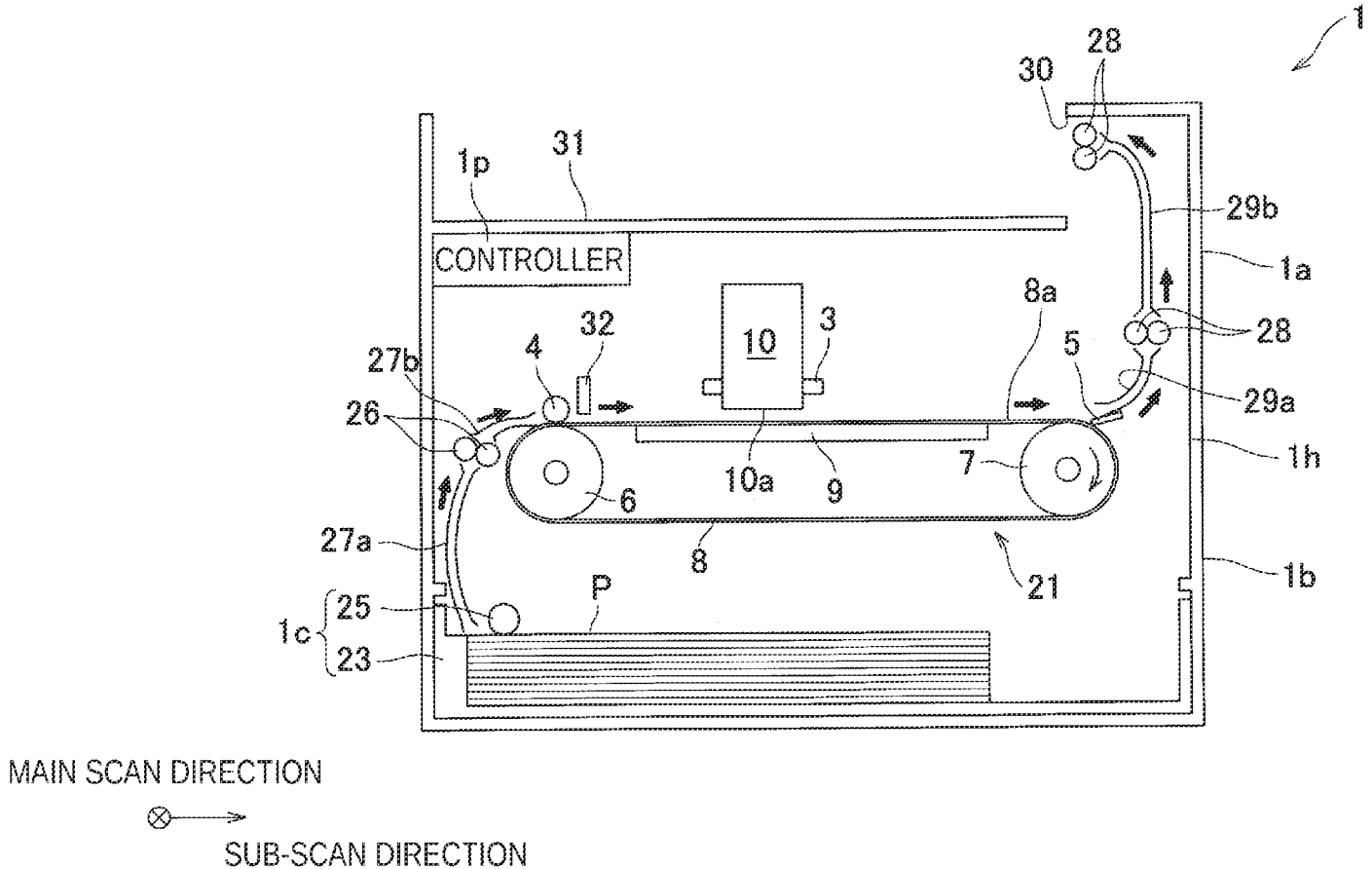
FIG. 2 is a side view schematically illustrating the inside of the printer.

On a top board of the first housing 1*a*, a sheet discharge unit 31 is provided in the space defined by the first housing 1*a* and the second housing 1*b*, a transfer path to transfer sheet P is formed along thick arrows shown in FIG. 2 from a sheet feeding unit 1*c* to the sheet discharge unit 31.

The first housing 1*a* has one side of a lower end, which is joined as a hinge 1*h* with the second housing 1*b*, so as to be movable (rotatable) with respect to the second housing 1*b*. Therefore, the movement enables the first housing 1*a* to take a proximity position (a position shown in FIG. 2) close to the second housing 1*b* and a separated position (a position shown in FIG. 1) farther from the second housing 1*b* than the proximity position. In other words, the first housing 1*a* is movable with respect to the second housing 1*b* between the proximity position and the separated position.

When the first housing 1*a* is in the separated position, the transfer path formed in the second housing 1*b* is exposed such that workspace for a user is secured on the transfer path. In this case, the user can manually perform jam fixing operation or the like by using the workspace.

The first housing 1*a* is provided with a locking mechanism (not shown) for restricting (regulating) the movement of the first housing 1*a* at the proximity position. The locking mechanism can be released to move the first housing 1*a* from the proximity position to the separated position. After the first housing 1*a* returns from the separated position to the proximity position, the movement of the first housing 1*a* is again restricted by the locking mechanism.

The first housing 1*a* is biased in a direction from the proximity position to the separated position by a spring or the like. When the first housing 1*a* is moved from the proximity position to the separated position, the first housing 1*a* can be opened up to an inclination angle of about 35 degree with respect to a horizontal plane and further movement is restricted (regulated) by a stopper or the like.

That is, in this illustrative embodiment, the proximity position is a position along the horizontal plane, and the separated position is a position inclined at about 35 degree with respect to the horizontal plane.

The first housing 1*a* accommodates an inkjet head 10, a controller 1*p* (see FIG. 2) for controlling operations of individual units of the printer 1, an ink supply source (an ink cartridge and a sub tank which are not shown) for the inkjet head 10, and the like. The ink cartridge stores, for example, black ink. The ink in the cartridge is supplied to the inkjet head 10 through the sub-tank, for example, by driving a pump.

The second housing 1*b* accommodates a transfer unit 21, the sheet feeding unit 1*c*, and the like.

The head 10 is of a line type elongated in the main scan direction and has a substantially rectangular parallelepiped outer shape. The head 10 is supported on the first housing 1*a* by a frame 3. On an upper surface of the head 10, a joint with a flexible tube attached thereto is provided, and on an ejecting surface 10*a* of a lower surface of the head 10, a plurality of ejecting openings are formed. In the head 10, flow paths are formed to supply ink supplied from a corresponding cartridge through the tube and the joint to the individual ejecting openings.

Based on a record instruction supplied from an external device (a PC or the like connected to the printer 1), the controller 1*p* performs control on a preparation operation for recording, operations of feeding, transferring, and ejecting sheet P, an ink ejecting operation synchronized with the operation of transferring the sheet P, and the like, such that an image is recorded on the sheet P.

The controller 1*p* includes a central processing unit (CPU) which is an arithmetic processing unit, a read only memory (ROM), a random access memory (RAM) which includes a non-volatile RAM, an interface (I/F), and the like. The ROM stores a program executable by the CPU, various fixed data, and the like. The RAM temporarily stores data (image data and the like) necessary during execution of the program. The controller 1*p* performs data communication with an external device through the I/F.

The sheet feeding unit 1*c* includes a sheet feeding tray 23 and a sheet feeding roller 25. The sheet feeding tray 23 is detachably attached in the main scan direction with respect to the second housing 1*b*. The sheet feeding tray 23 is a box with its upper surface opened, and can accommodate sheets of sheet P having a plurality of kinds of sizes. The sheet feeding roller 25 is controlled to rotate and send the uppermost sheet of sheet P in the sheet feeding tray 23 by the controller 1*p*. The sheet P sent by the sheet feeding roller 25 is guided by guides 27*a* and 27*b*, and is transferred to the transfer unit 21 by a pair of transfer rollers 26 while being interposed between the transfer rollers 26.

The transfer unit 21 includes two belt rollers 6 and 7, an endless conveyor belt 8 looped around the rollers 6 and 7, a nip roller 4 and a separation plate 5 disposed outside the conveyor belt 8, a platen 9 disposed inside the conveyor belt 8, and the like.

The belt roller 7 is a driving roller and is controlled to rotate clockwise in FIG. 2 by the controller 1*p*. According to the rotation of the belt roller 7, the conveyor belt 8 rotates in a direction denoted by the thick arrows in FIG. 2. The belt roller 6 is a driven roller and rotates clockwise in FIG. 2 as the conveyor belt 8 rotates. The nip roller 4 is disposed to face the belt roller 6 and presses the sheet P sent from the sheet feeding unit 1*c* against an outer circumferential surface 8*a* of the conveyor belt 8. The separation plate 5 is disposed to face the belt roller 7, separates the sheet P from the outer circumferential surface 8*a*, and guides the sheet P to the sheet discharge unit 31. The platen 9 is disposed to face the head 10 and supports an upper loop of the conveyor belt 8 from the inside. Therefore, a predetermined gap appropriate for image recording is defined between the outer circumferential surface 8*a* and the ejecting surface 10*a*.

On the outer circumferential surface 8*a* of the conveyor belt 8, a low-adhesion silicon layer is formed. The sheet P which is sent from the sheet feeding unit 1*c* to the transfer unit 21 is pressed against the outer circumferential surface 8*a* by the nip roller 4, and then is transferred in the sub-scan direction along thick arrows while being held on the outer circumferential surface 8*a* by the adhesion.

Herein, the sub-scan direction is a direction parallel to the transfer direction of the sheet P by the conveyor belt 8. The main scan direction is a direction perpendicular to the sub-scan direction and parallel to the horizontal plane.

When the sheet P passes directly below the head 10, under the control of the controller 1*p*, the head 10 is driven and the ink is ejected from the ejecting surface 10*a* to the sheet P, such that an image is formed on the sheet P. The ink ejecting operation is performed on the basis of a detection signal from a sheet sensor 32. Then, the sheet P is separated from the outer circumferential surface 8*a* by the separation plate 5, is guided by guides 29*a* and 29*b*, is transferred upward while being interposed between two pairs of transfer rollers 28, and is ejected from an opening 30 formed in an upper portion of the first housing 1*a* to the sheet discharge unit 31. One roller of each pair of transfer rollers 28 is controlled to rotate by the controller 1*p*.

Figure 1:
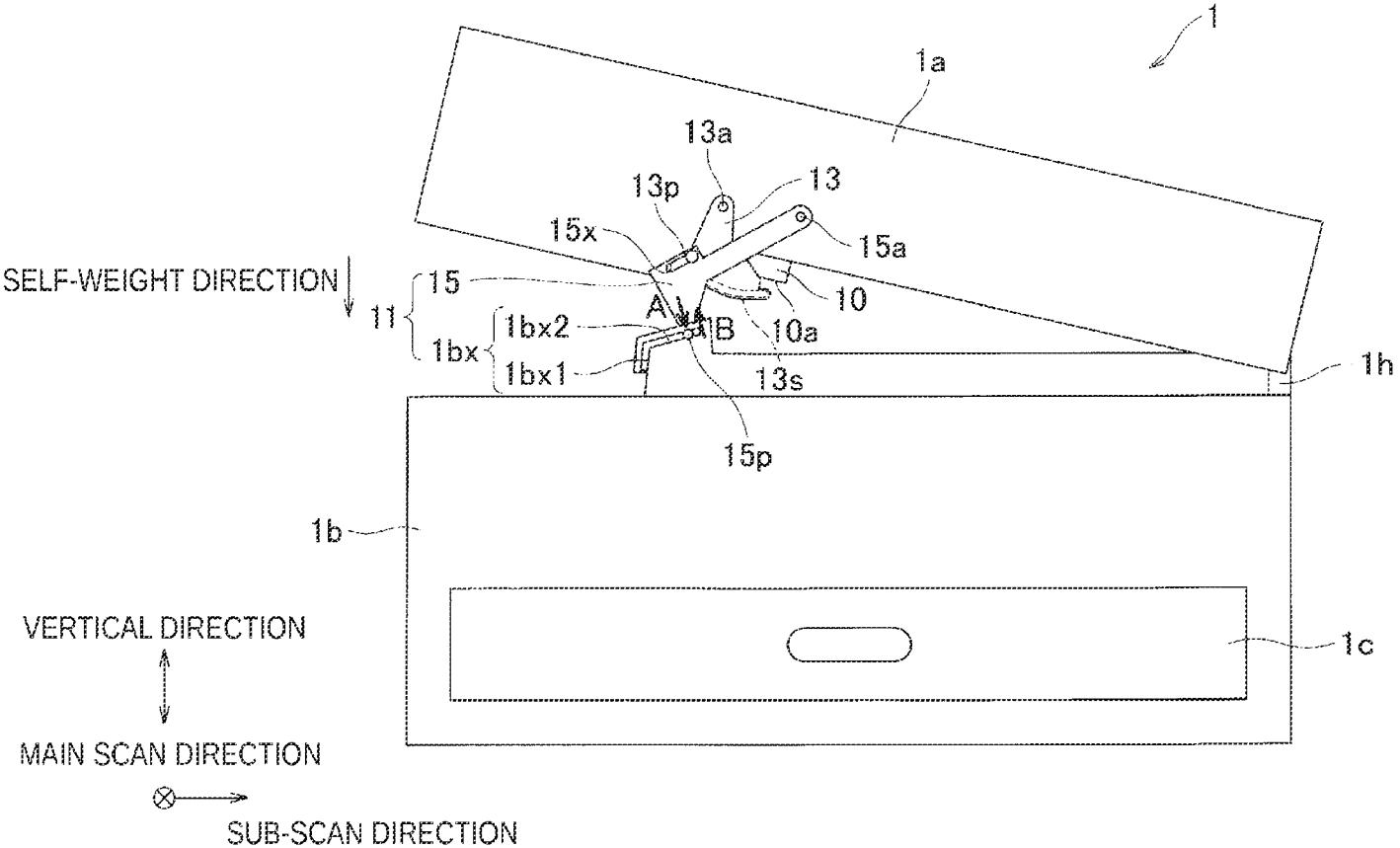
FIG. 1 is a side view illustrating an outer configuration of an inkjet printer according to an illustrative embodiment of the present invention.
Figure 3A:
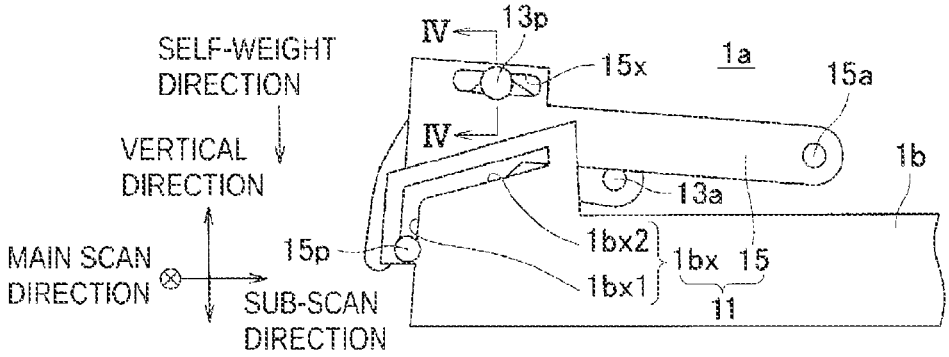
FIGS. 3A to 3C are partial side views illustrating a movement mechanism.

In the first housing 1*a*, a cover 13 for covering the ejecting surface 10*a* is attached as shown in FIG. 1. The cover 13 is movable with respect to the head 10, and can take a protection position (a position shown in FIG. 1) to cover the ejecting surface 10*a* and a retreat position (a position shown in FIG. 3A) not to cover the ejecting surface 10*a* by the movement. In other words, the cover 13 is movable with respect to the head 10 between the protection position and the retreat position.

The cover 13 includes a main body extending in the main scan direction and two side portions formed at both ends in the main scan direction of the main body, respectively. In FIGS. 1 and 3, only one side portion is shown. The main body of the cover 13 is a plate-shaped member which has a length greater than that of the ejecting surface 10*a* in the main scan direction and faces the entire body of the ejecting surface 10*a* when the cover 13 is in the protection position. The individual side portions protrude in a direction perpendicular to the main scan direction from the end portions of the main body of the cover 13 in the main scan direction, and are supported on side portions of the first housing 1*a* by a shaft 13*a*. The cover 13 is rotatable on the shaft 13*a*.

The ejecting surface 10*a* is disposed vertically downward regardless of whether the first housing 1*a* is in the separated position or the proximity position. When the first housing 1*a* is in the separated position, the main body of the cover 13 covers the ejecting surface 10*a* from the vertically lower side (see FIG. 1). Over the substantially entire top surface (a portion facing the ejecting surface 10*a* when the cover 13 is in the protection position) of the main body of the cover 13, sponge 13*s* for absorbing ink is provided.

The printer 1 includes a movement mechanism 11 for moving the cover 13 in accordance with the movement of the first housing 1*a* such that the cover 13 takes the retreat position when the first housing 1*a* is in the proximity position (see FIG. 3A), and takes the protection position when the first housing 1*a* is in the separated position (see FIG. 1).

Hereinafter, a configuration of the movement mechanism 11 will be described with reference to FIGS. 1, 3A, 3B, 3C, and 4.

The movement mechanism 11 includes an intermediate member 15 having a protrusion 15*p* and a hole 1*bx* formed in the second housing 1*b*. The movement mechanism 11 are provided for the individual side portions of the cover 13; however, FIGS. 1, 3A, 3B and 3C show only one movement mechanism 11 (that is, FIGS. 1, 3A, 3B, and 3C shows a movement mechanism 11 provided on the front side of the printer 1; however, an identical movement mechanism 11 is provided on the rear side of the printer 1).

The intermediate member 15 is supported on the side portion of the first housing 1*a* by the shaft 15*a* while being interposed between a side portion (a portion except for a pin 13*p* to be described below) of the cover 13 and the second housing 1*b*. The intermediate member 15 is rotatable on the shaft 15*a*.

The shaft 15*a* is provided such that the distance between the shaft 15*a* and the pin 13*p* is greater than the distance between the shaft 13*a* and the pin 13*p*.

The intermediate member 15 includes an elongated portion having a longitudinal end where the shaft 15*a* is provided, and a main body connected to the other longitudinal end of the elongated portion. The main body of the intermediate member 15 has a long hole 15*x* and the protrusion 15*p* formed therein.

The long hole 15*x* extends in the same direction as the longitudinal direction of the elongated portion and penetrates through the main body of the intermediate member 15 in a thickness direction. The pin 13*p* provided to the side portion of the cover 13 is inserted into the long hole 15*x*.

Figure 4:
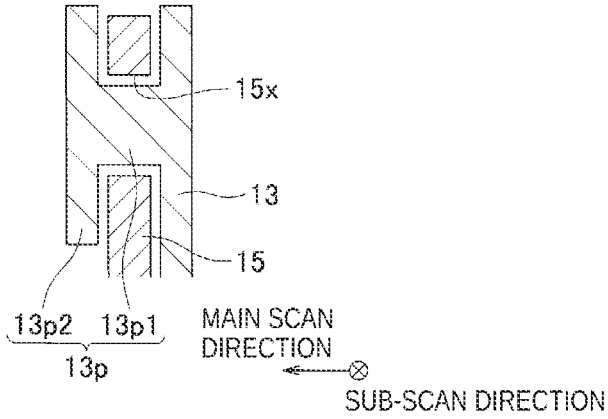
FIG. 4 is a partial cross-sectional view taken along the line IV-IV of FIG. 3A.

As shown in FIG. 4, the pin 13*p* includes a protruding portion 13*p*1 protruding outward (toward the front side of the sheet plane of FIG. 1) from the side portion of the cover 13 along the main scan direction and disposed in the long hole 15*x*, and an expanded portion 13*p*2 formed at the tip end of the protruding portion 13*p*1 and disposed outside the long hole 15*x*. As seen from the main scan direction, the protruding portion 13*p*1 has a circular shape smaller than the width of the long hole 15*x*, while the expanded portion 13*p*2 has a circular shape larger than the protruding portion 13*p*1 and larger than the width of the long hole 15*x*. Consequently, the expanded portion 13*p*2 extends outside both ends in the width direction of the long hole 15*x*. Therefore, the pin 13*p* is prevented from dropping out from the long hole 15*x*, and the engagement of the intermediate member 15 and the cover 13 is maintained.

Although not shown, the protrusion 15*p* includes a protruding portion and an expanded portion, similarly to the pin 13*p*. Therefore, the protrusion 15*p* is prevented from dropping out from the hole 1*bx*, and engagement of the intermediate member 15 and the second housing 1*b* is maintained.

The protrusion 15*p* is movable along the hole 1*bx* while the protrusion 15*p* is inserted into the hole 1*bx*. The cover 13 moves between the retreat position and the protection position in association with the movement of the protrusion 15*p*.

The hole 1*bx* penetrates through a side wall of the second housing 1*b* in a thickness direction of the wall.

The hole 1*bx* includes a parallel portion 1*bx*1 extending in a direction parallel to a direction of a force applied to the protrusion 15*p* due to the self-weight of the printer 1 (which is a vertically downward direction in this illustrative embodiment and will be referred to as a self-weight direction later), and an intersecting portion 1*bx*2 extending in a direction intersecting with the self-weight direction (which is a direction inclined to the horizontal plane as seen from the main scan direction).

An upper end of the parallel portion 1*bx*1 and one end of the intersecting portion 1*bx*2 are connected to each other. That is, the entire hole 1*bx* has a bent shape extending from a lower end of the parallel portion 1*bx*1 to the other end of the intersecting portion 1*bx*2 through the upper end of the parallel portion 1*bx*1 and the one end of the intersecting portion 1*bx*2.

Next, an operation of the cover 13 and the movement mechanism in accordance with the movement of the first housing 1*a* will be described with reference to FIGS. 1, 3A, 3B and 3C.

For example, while the first housing 1*a* is in the proximity position (see FIG. 3A) and each operation based on a record instruction is being performed, if a jam (jamming of sheet P on the transfer path) is detected, restriction by the locking mechanism is released so as to allow the user to move the first housing 1*a* from the proximity position to the separated position.

When the first housing 1*a* is in the proximity position (see FIG. 3A), the protrusion 15*p* is disposed in the lower end of the parallel portion 1*bx*1 and the cover 13 is in the retreat position. In this case, the protrusion 15*p* abuts on a wall of the lower end of the parallel portion 1*bx*1.

The first housing 1*a* is lifted up by the user so as to move from the proximity position (see FIG. 3A) to the separated position (see FIG. 1). In this case, the protrusion 15*p* moves along the hole 1*bx* such that the intermediate member 15 rotates on the shaft 15*a* counterclockwise as shown in FIGS.

Figure 3B:
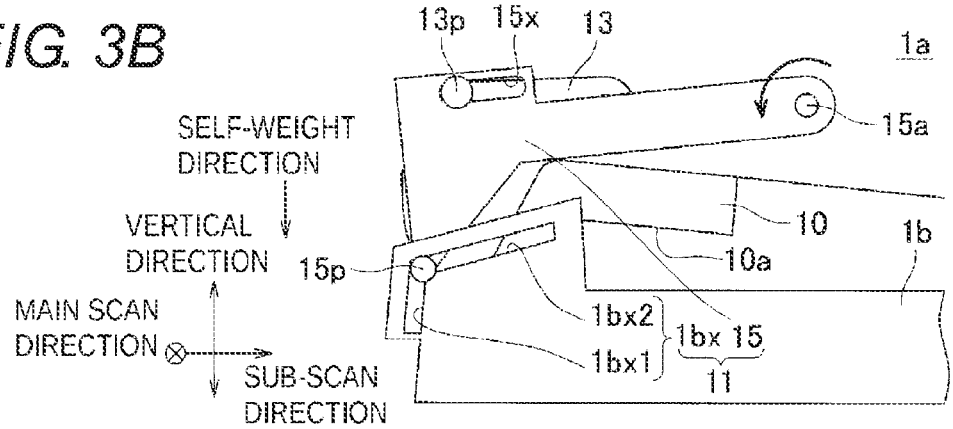
Figure 3C:
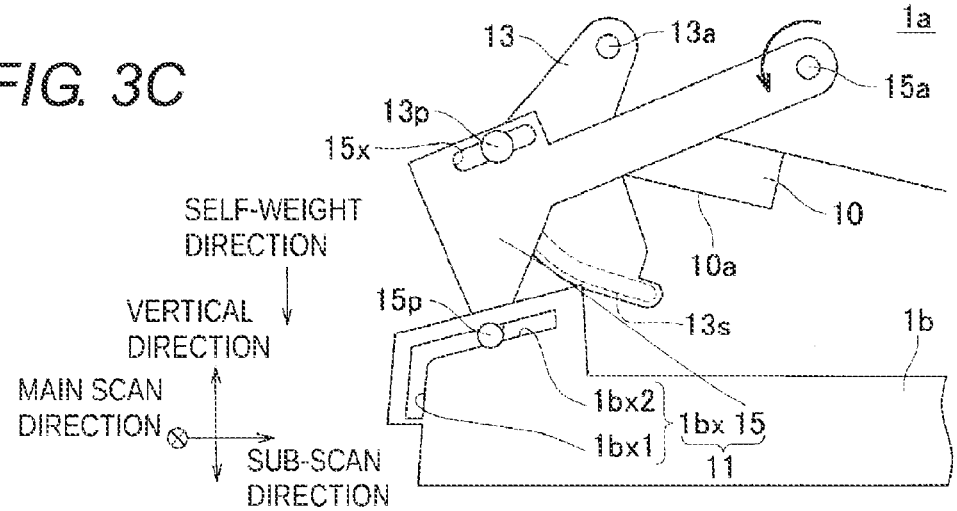

3B and 3C. Further, in this case, the pin 13*p* is pressed against a wall of the long hole 15*x*, such that the cover 13 rotates on the shaft 15*a* counterclockwise as shown in FIGS. 3B and 3C, in accordance with the rotation of the intermediate member 15.

While the first housing 1*a* is moved from the proximity position to the separated position, a first stage in which the protrusion 15*p* moves along the parallel portion 1*bx*1 (see FIGS. 3A and 3B) and a second stage in which the protrusion 15*p* moves along the intersecting portion 1*bx*2 (see FIG. 3C) sequentially occur in this order.

That is, in this illustrative embodiment, the hole 1*bx* includes the parallel portion 1*bx*1 and the intersecting portion 1*bx*2. While the first housing 1*a* is moved from the proximity position to the separated position, the movement amount of the cover 13 with respect to a change amount of an angle between the first housing 1*a* and the second housing 1*b* varies between the first stage and the second stage. Specifically, the movement amount of the cover 13 in the first stage is smaller than that in the second stage.

When the first housing 1*a* reaches the separated position (see FIG. 1), the protrusion 15*p* is disposed in the other end of the intersecting portion 1*bx*2.

In this state, if a force to move the cover 13 from the retreat position to the protection position is applied, a force is applied to the protrusion 15*p* in an A direction shown in FIG. 1. Meanwhile, if a force to move the cover 13 from the protection position to the retreat position, a force is applied to the protrusion 15*p* in a B direction shown in FIG. 1. However, the protrusion 15*p* abuts on side walls of the hole 1*bx* (side walls of an end portion in a width direction of the intersecting portion 1*bx*2) with respect to both of the A and B directions, such that the movement of the protrusion 15*p* is restricted by the side walls. Therefore, the force applied to the protrusion 15*p* is distributed to the second housing 1*b* through the side walls of the hole 1*bx*.

As described above, according to the printer 1 of the illustrative embodiment, when the first housing 1*a* is in the separated position (see FIG. 1), the movement of the protrusion 15*p* with respect to both of the A and B directions is restricted by the side walls of the hole 1*bx*. In this case, since the protrusion 15*p* moves in accordance with the movement of the cover 13, the movement of the cover 13 can also be restricted so as to effectively maintain the cover 13 at the protection position.

Further, the movement mechanism 11 of the above-described illustrative embodiment is not based on driving of electric power. In a case of a movement mechanism 11 based on driving of electric power, there are problems in which the configuration is complicated and the movement mechanism 11 does not operate unless electric power is applied. In contrast, the movement mechanism 11 of the illustrative embodiment has a comparatively simple configuration and operates even when electric power is not applied.

When the first housing 1*a* is in the separated position (see FIG. 1), if the self-weight direction is parallel to an extending direction of the intersecting portion 1*bx*2, even when an external fore is not applied, it is easy for the protrusion 15*p* to move along the intersecting portion 1*bx*2. However, according the above-described illustrative embodiment, since the self-weight direction intersects with the extending direction of the intersecting portion 1*bx*2, unless a strong external force is applied, it is difficult for the protrusion 15*p* to move along the intersecting portion 1*bx*2. Therefore, it is possible to effectively restrict the movement of the cover 13.

When the first housing 1*a* is in the separated position (see FIG. 1), the self-weight direction intersects with the extending direction of the intersecting portion 1*bx*2, whereby the movement mechanism 11 is configured to position the first housing 1*a* with respect to the second housing 1*b*. Therefore, it is possible to reliably prevent the first housing 1*a* in the separated position from being opened too wide or moving to the proximity position by the movement mechanism 11.

It is noted that, in the above-described illustrative embodiment, although the stopper or the like also prevents the first housing 1*a* from being opened too wide, the first housing 1*a* is further reliably prevented form being opened too wide by the positioning function of the movement mechanism 11 as described above.

The cover 13 has the sponge 13*s* at a portion facing the ejecting surface 10*a* when the cover 13 is in the protection position. Therefore, in a case where the ink is leaked from the ejecting openings when the cover 13 is in the protection position, the ink is held in the sponge 13*s*. Therefore, it is possible to prevent the ink from being scattered in the printer 1.

When the first housing 1*a* is in the separated position (see FIG. 1), the ejecting surface 10*a* is directed vertically downward, and the cover 13 covers the ejecting surface 10*a* from the vertically lower side. Even when the ink is leaked from the ejecting openings, since the ink is accommodated on the cover 13, it is possible to prevent the ink from being scattered in the printer 1.

The hole 1*bx* includes the parallel portion 1*bx*1 and the intersecting portion 1*bx*2. While the first housing 1*a* is moved from the proximity position to the separated position, the first stage in which the protrusion 15*p* moves along the parallel portion 1*bx*1 (see FIGS. 3A and 3B) and the second stage in which the protrusion 15*p* moves along the intersecting portion 1*bx*2 (see FIG. 3C) sequentially occur in this order.

The first housing 1*a* and the second housing 1*b* are closer to each other in the first stage than in the second stage. Therefore, if the cover 13 moves toward the protection position at high speed in the first stage, the cover 13 may collide with the second housing 1*b*. The first housing 1*a* and the second housing 1*b* are farther from each other in the second stage than in the first stage. Therefore, in the second stage, if the cover 13 rapidly moves toward the protection position, there occurs no collision problem. As described above, the movement amount of the cover 13 changes, so as to move the cover 13 to the protection position while suppressing a problem such as a collision between the cover 13 and the second housing 1*b*.

Further, in the first stage, even when the external force applied to the protrusion 15*p* is weak, the protrusion 15*p* smoothly moves along the parallel portion 1*bx*1. In order to move the protrusion 15*p*, the second stage needs an external force stronger than the first stage. Therefore, even when the external force is applied to the protrusion 15*p* in the second stage (a state where the first housing 1*a* and the second housing 1*b* are far from each other), it is possible to effectively restrict the movement of the protrusion 15*p* and further the movement of the cover 13.

According to the above-described illustrative embodiment, the distance between the shaft 15*a* of the intermediate member 15 and the pin 13*p* is greater than the distance between the shaft 13*a* of the cover 13 and the pin 13*p*. Therefore, the rotation angle of the cover 13 about the shaft 13*a* when the cover 13 is moved from the retreat position to the protection position is greater than the rotation angle of the intermediate member 15 about the shaft 15*a* when the cover 13 is moved from the retreat position to the protection position. Therefore, it is possible to effectively increase the rotation angle of the cover 13, as compared to a case where the intermediate member 15 is not provided.

While the present invention has been shown and described with reference to certain illustrative embodiments thereof, it will be understood by those skilled in the art that various changes in form and details may be made therein without departing from the spirit and scope of the invention as defined by the appended claims.

For example, a support member to support the sheet P to face the ejecting surface 10*a* is not limited to the belt, but may be a platen or the like.

Further, the hole formed in the second housing and the protrusion provided on the intermediate member may have various forms. For example, the hole may be any one of a though-hole or a hole (a recess) which does not penetrate through the second housing in the thickness direction. Further, the protrusion may not include the expanded portion for preventing the protrusion from dropping out from the hole.

A liquid holding member for holding liquid at a portion facing the ejecting surface 10*a* is not limited to a sponge or the like for absorbing a liquid, but may be cloth, a member for holding liquid by a capillary phenomenon (a member in which a number of protrusions are densely disposed), and the like, as long as it can hold liquid.

The first housing is not necessarily rotatable on the hinge with respect to the second housing, but may move vertically or horizontally, for example. Similarly, the cover is also not necessarily rotatable but may move vertically or horizontally.

The first housing may move between the proximity position and the separated position by a mechanical mechanism controlled by the controller 1*p*, not by manual manipulation of the user.

The present invention is applicable to both of a line type and a serial type head. Further, the inventive concept of the present invention can be applied not only to the printer but also a facsimile, a copy machine, and the like.

The liquid ejecting head may eject arbitrary liquid other than the ink. Further, the liquid ejecting device may include one or more liquid ejecting heads. In a case where two or more liquid ejecting heads are provided, a cover and a movement mechanism may be provided for each head.

The record medium is not limited to the sheet P, but may be an arbitrary recordable medium.

What is claimed is:

1. A liquid ejecting device comprising:

a first housing; and a second housing, wherein the first housing is movable with respect to the second housing between a proximity position close to the second housing and a separated position farther from the second housing than the proximity position, and accommodates a liquid ejecting head including an ejecting surface having a plurality of ejecting openings formed thereon for ejecting liquid to a record medium, wherein the second housing accommodates a support member configured to support the recording medium to face the ejecting surface, wherein the liquid ejecting device further comprises:

a cover which is attached to the first housing, and which is movable with respect to the liquid ejecting head between a protection position to cover the ejecting surface and a retreat position not to cover the ejecting surface; and a movement mechanism which is configured to cause the cover to move in accordance with the movement of the first housing such that the cover takes the retreat position when the first housing is in the proximity position and takes the protection position when the first housing is in the separated position, wherein the movement mechanism includes:

a hole formed in the second housing; and an intermediate member attached to the first housing and engaged with the cover, the intermediate member having a protrusion which is movable along the hole while being inserted into the hole and which is moved in accordance with the movement of the cover, and wherein when the first housing is in the separated position, the protrusion abuts on side walls of the hole with respect to (i) a first direction in which a force to move the cover from the retreat position to the protection position is applied and (ii) a second direction in which a force to move the cover from the protection position to the retreat position is applied, whereby movement of the protrusion in the first direction and in the second direction is restricted by the side walls;

wherein the hole includes:

a parallel portion extending in parallel to a direction of a force applied to the protrusion due to a self-weight of the liquid ejecting device; and an intersecting portion extending in a direction intersecting with the direction due to the self-weight; and wherein when the first housing is in the proximity position, the protrusion is disposed in the parallel portion, and when the first housing is in the separated position, the protrusion is disposed in the intersecting portion.

2. The liquid ejecting device according to claim 1, wherein when the first housing is in the separated position, a direction of a force applied to the protrusion due to a self-weight of the liquid ejecting device intersects with an extending direction of the hole.

3. The liquid ejecting device according to claim 2, wherein the movement mechanism is configured to position the first housing with respect to the second housing.

4. The liquid ejecting device according claim 1, wherein the cover comprises a liquid holding member configured to hold liquid at a portion facing the ejecting surface when the cover is in the protection position.

5. The liquid ejecting device according to claim 1, wherein when the first housing is in the separated position, the ejecting surface is directed vertically downward and configured to cover the ejecting surface from a vertically lower side.

6. The liquid ejecting device according to claim 1, wherein the intermediate member is formed with a hole, wherein the cover has a protrusion which is inserted into and movable along the hole of the intermediate member, wherein the intermediate member is rotatable on a first shaft provided to the first housing, wherein the cover is rotatable on a second shaft provided to the first housing at a position different from the first shaft, and wherein a distance between the first shaft and the protrusion of the cover is greater than a distance between the second shaft and the protrusion of the cover.

7. The liquid ejecting device according to claim 1, wherein the intermediate member has a first end and a second end opposite to the first end, and the first end of the intermediate member is supported by a shaft provided to the first housing such that the intermediate member is rotatable about the shaft, wherein the protrusion is provided at the second end of the intermediate member, wherein the hole has a first end and a second end opposite to the first end, wherein the intermediate member is configured to rotate such that the protrusion is positioned at the first end of the hole when the first housing is in the proximity position and the protrusion is positioned at the second end of the hole when the first housing is in the separated position.

* * * * *